United States Patent [19]

Vohl

[11] 4,184,274

[45] Jan. 22, 1980

[54] EJECTION TUBE ASSEMBLY FOR A SNOWBLOWER

[76] Inventor: Paul-Eugène Vohl, 1738 rue Principale, St-Marc-des-Carrières, Québec, Canada

[21] Appl. No.: 922,074

[22] Filed: Jul. 5, 1978

[30] Foreign Application Priority Data

Aug. 31, 1977 [CA] Canada ..... 285908

[51] Int. Cl.[2] ..... E01H 5/00

[52] U.S. Cl. ..... 37/43 R; 406/191

[58] Field of Search ..... 37/43 R–43 K, 37/53, 19–27, 12; 138/118–120, 109; 285/298, 302; 193/30; 302/9, 10, 16, 34, 59, 60, 63; 239/689; 198/313, 640, 641

[56] References Cited

U.S. PATENT DOCUMENTS

| | | | |
|---|---|---|---|
| 805,997 | 11/1905 | Puterbaugh | 302/9 |
| 958,137 | 5/1910 | Kirkpatrick | 302/9 |
| 997,307 | 7/1911 | MacGregor | 302/9 |
| 1,157,532 | 10/1915 | Harper | 239/689 |
| 1,355,632 | 10/1920 | Wettlaufer | 302/9 |
| 2,092,536 | 9/1937 | Sicard | 37/43 E |
| 2,642,680 | 6/1953 | Curtis et al. | 37/43 E |
| 2,807,120 | 9/1957 | Graham | 302/10 |
| 3,041,748 | 7/1962 | Wetzel | 37/19 X |
| 3,088,779 | 5/1963 | Vachon | 37/43 R X |
| 3,205,017 | 9/1965 | Story et al. | 302/34 |

FOREIGN PATENT DOCUMENTS

| | | | |
|---|---|---|---|
| 168439 | 11/1950 | Austria | 37/43 R |
| 2103203 | 8/1972 | Fed. Rep. of Germany | 37/43 E |

*Primary Examiner*—E. H. Eickholt

[57] ABSTRACT

An ejection tube assembly for a snowblower, wherein the assembly comprises a bottom tube section and an upper tube section which are telescopically extendible and retractable one in the other to form an ejection tube of sufficient height to load the present-day trucks and of reducible height to enter in a conventional garage. This ejection tube assembly includes a support, the ejection tube extending endwise upright on this support, a slender casing upwardly extending lengthwise, having an open bottom, and laterally fixed to the upper tube section for displacement therewith, a hydraulic cylinder engaged in the slender casing and fixed at the lower end to the support and guide rods fixed to the slender casing, longitudinally extending lengthwise thereof, and slidable in guiding sleeves fixed to the support.

3 Claims, 6 Drawing Figures

EJECTION TUBE ASSEMBLY FOR A SNOWBLOWER

This invention relates to a snowblower and, more particularly, to an ejection tube assembly of the type used by a snowblower to upwardly eject the snow, such as to load a truck.

The snowblowers which have been proposed so far have been provided with an ejection tube of relatively fixed height. This has been satisfactory until recently when trucks with higher and higher sides have been introduced to transport the snow picked up by the snowblowers. To follow this trend of higher sides and larger truck boxes, the ejection tube must be made longer. The resulting snowblowers with an ejection tube of extended and fixed length have an overall height which is excessive for convenient entry into a conventional garage.

It is a general object of the present invention to provide an ejection tube assembly for a snowblower which allows to load the trucks having higher sides and yet which may conveniently enter into a conventional garage.

It is a more specific object of the present invention to provide an ejection tube assembly wherein the ejection tube is extendible and retractable to load trucks having higher sides and to also conveniently enter into a conventional garage.

It is a specific object of the present invention to provide an ejection tube assembly wherein the ejection tube is telescopically extendible and retractable.

The above and other objects and advantages of the present invention will be better understood with reference to the following detailed description of a preferred embodiment thereof which is illustrated, by way of example, in the accompanying drawings, in which.

Figure 5:
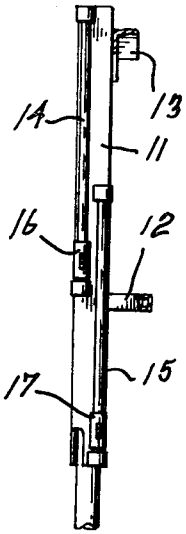
FIG. 5 is a cross-sectional view as seen along line 5—5 in FIG. 4.
Figure 6:
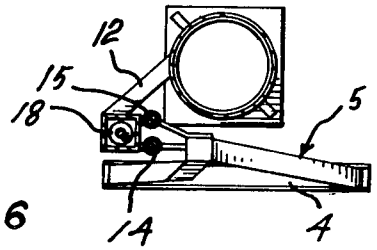
FIG. 6 is a cross-sectional view as seen along line 6—6 in FIG. 4.
Figure 4:
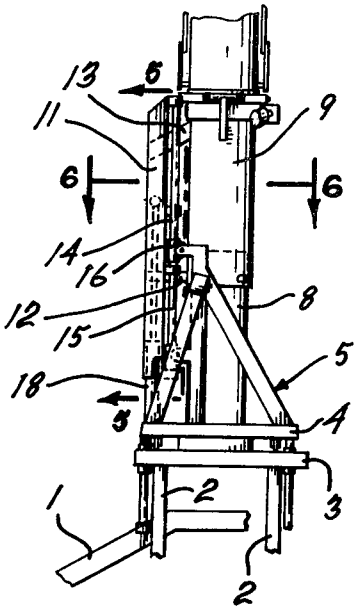
FIG. 4 is a rear elevation view of the ejection tube assembly.

The illustrated ejection tube assembly includes a support formed of a crossbeam 1, uprights 2, crossbars 3, 4, and an upwardly extending bracket 5. This support is operatively fixed to a snow blowing unit 6 operatively hitched to the front of an appropriate tractor 7.

The ejection tube assembly also includes an ejection tube constituted of a bottom tube section 8, an upper tube section 9, and a deflection neck 10. The lower tube section 8 is fixed endwise upright on the support and the upper tube section telescopically engages the lower tube section for up-and-down sliding displacements thereof relative to the lower tube section and the mounting support. The deflection neck, or chute section 10, is of conventional or known construction with adjustable linkage to articulate the neck and thus adjust the throwing distance and height, as is known in the art.

Means are provided to guide the telescopic sliding of the upper tube section 9 relative to the fixed lower tube section 8. This guiding means includes a slender casing 1 which is rigidly fixed by brackets 12 and 13 to the upper tube section 9 and longitudinally extends parallel to the latter. The slender casing 11 has an open bottom end and is bodily displaceable with the upper tube section 9. The guiding means further includes a guiding section and a guided section forming a guideway operatively extending parallel to the ejection tube sections 8 and 9.

The guided section includes a pair of guide rods 14 and 15 rigidly fixed against one side of the slender casing 11 and extending parallel to the latter and to the ejection tube sections 8 and 9. The guide rods 14 and 15 are thus bodily displaceable endwise with the slender casing 11 and the upper tube section 9. The guide rods 14 and 15 are arranged one higher than the other and so define a higher guide rod 14 and a lower guide rod 15.

The guiding section includes a pair of sleeves 16 and 17 slidably engaged around the guide rods 14 and 15, respectively, and both fixed to the bracket 5.

Figure 1:
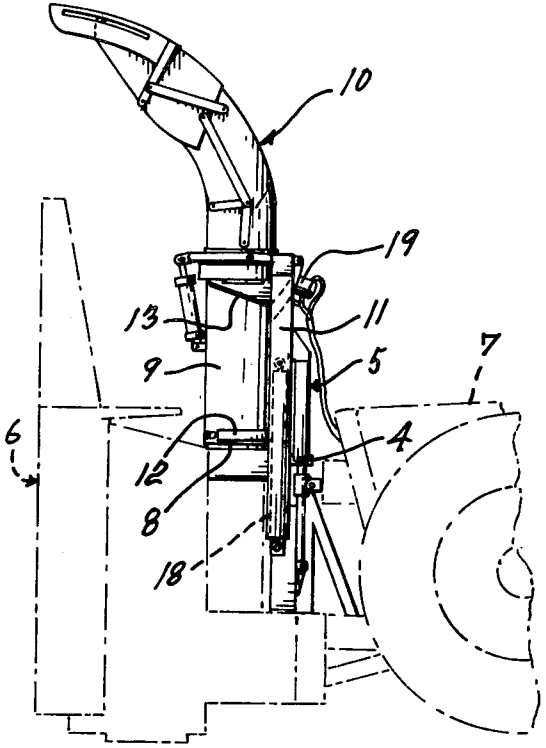
FIG. 1 is a side elevation view of an ejection tube assembly according to the present invention operatively associated to a snowblower shown in phanton lines.
Figure 3:
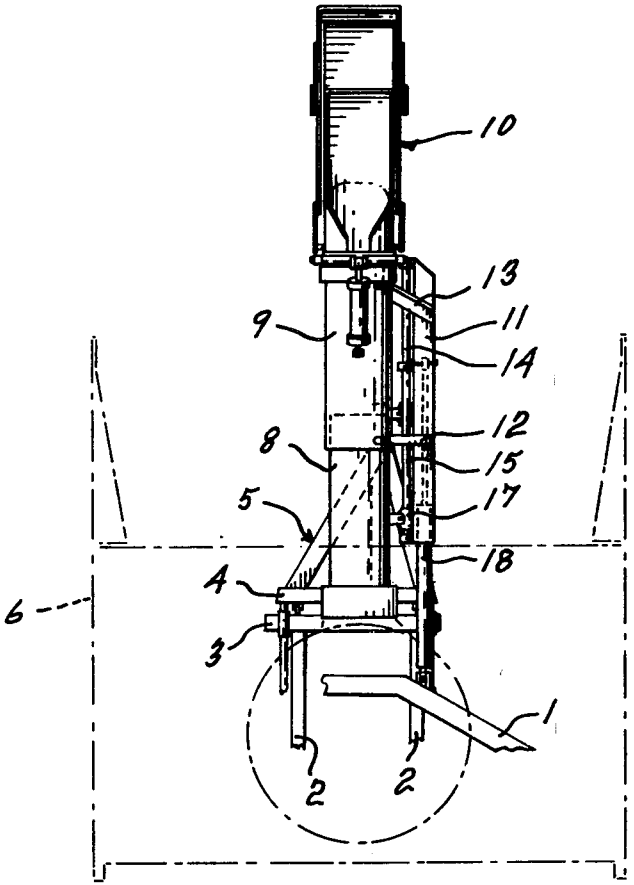
FIG. 3 is a view as in FIG. 2 but this time with the ejection tube in extended configuration.
Figure 2:
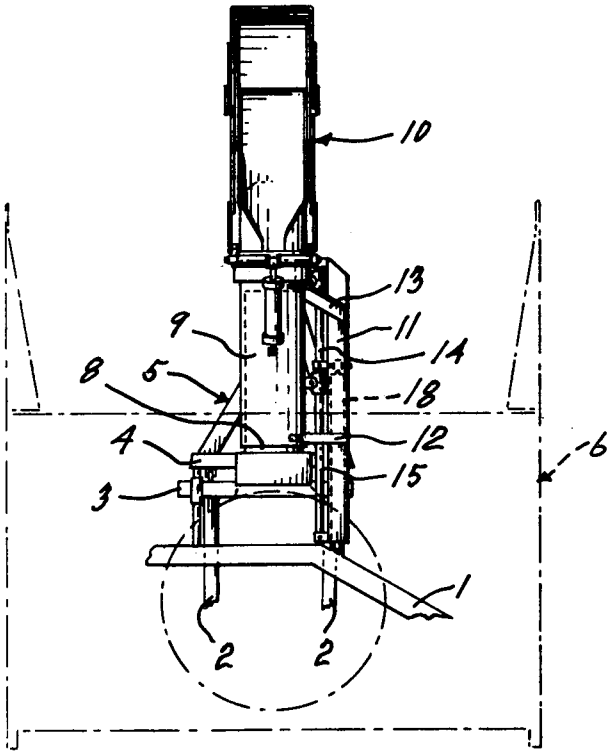
FIG. 2 is a front elevation view of the ejection tube assembly as seen from the left in FIG. 1.

A hydraulic cylinder 18 extends in the slender casing 11 and is connected at its upper end in the latter, and at its lower end to the crossbeam 1 to selectively and telescopically extend and retract the ejection tube upon displacement of the slender casing 11 and the upper tube section 9. Thus, the ejection tube may be retracted, as shown in FIGS. 1 and 2, such as to allow the snowblower to enter a conventional garage door. On the other hand, the ejection tube is extended to reach as high as possible to load a truck or to blow the snow over a high snow bank or over some other obstacle.

As aforementioned, the deflection neck 10 is of known construction and includes a hydraulic motor 19 to swivel it in any desired direction.

What I claim is:

1. An ejection tube assembly for a snowblower, said assembly comprising, in combination, support means operatively fixable to the snowblower, an ejection tube upwardly extending endwise and including a lower and an upper tube sections, said lower tube section being fixed to said support means and said upper tube section telescopically engaging said lower tube section and being upwardly displaceable endwise relative to said support means, guide means including a guiding section and a guided section, said guiding section being fixedly connected to said upper tube section and operatively forming with the guiding section a guideway extending parallel to said ejection tube, and a hydraulic cylinder fixedly connected at the opposite ends relative to said tube sections, respectively, and extending parallel thereto, thereby telescopically extending and retracting said tube sections relative to each other for selective retraction and extension of the ejection tube and wherein said guided section includes a pair of guide rods fixedly secured relative to said upper tube section and bodily displaceable therewith and said guiding section includes a pair of sleeve members slidably holding said guide rods, respectively, and cooperatively defining therewith an upright guideway.

2. An ejection tube assembly as defined in claim 1, wherein said guide rods include a higher guide rod and a lower guide rod arranged in partial upright overlapping relationship and said sleeve members define an upper sleeve member and a lower sleeve member slidably holding said higher guide rod and lower guide rod, respectively.

3. An ejection tube assembly as defined in claim 2, wherein a slender casing upwardly extends lengthwise, has an open bottom and is fixedly secured to said upper tube section, said guide rods are fixedly secured to said slender casing outward thereof, and said hydraulic cylinder upwardly extends into said casing through the open bottom thereof.

* * * * *